US007086899B1

(12) United States Patent
Miyakawa et al.

(10) Patent No.: US 7,086,899 B1
(45) Date of Patent: Aug. 8, 2006

(54) WATERPROOF CONNECTOR

(75) Inventors: Tomoyuki Miyakawa, Shizuoka (JP); Kazuto Ohtaka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/266,249

(22) Filed: Nov. 4, 2005

(30) Foreign Application Priority Data

Jan. 27, 2005 (JP) ..... 2005-019470

(51) Int. Cl.
*H01R 13/40* (2006.01)

(52) U.S. Cl. ..... 439/587; 439/589; 439/475

(58) Field of Classification Search ..... 439/587, 439/589, 274, 275, 475
See application file for complete search history.

(56) References Cited

U.S. PATENT DOCUMENTS

| | | | | |
|---|---|---|---|---|
| 4,639,061 | A * | 1/1987 | Muzslay | 439/587 |
| 5,472,352 | A * | 12/1995 | Nishide et al. | 439/274 |
| 5,865,636 | A * | 2/1999 | Myer et al. | 439/275 |
| 6,217,394 | B1 * | 4/2001 | Sugie | 439/752.5 |
| 6,254,431 | B1 * | 7/2001 | Murakami et al. | 439/587 |
| 6,257,928 | B1 * | 7/2001 | Murakami et al. | 439/587 |
| 6,383,021 | B1 * | 5/2002 | Murakami et al. | 439/587 |
| 2001/0023149 | A1 * | 9/2001 | Murayama | 439/587 |
| 2002/0013089 | A1 * | 1/2002 | Ichio et al. | 439/587 |
| 2002/0127912 | A1 * | 9/2002 | Hamai et al. | 439/587 |
| 2003/0077939 | A1 * | 4/2003 | Fukuda | 439/587 |

FOREIGN PATENT DOCUMENTS

| | | |
|---|---|---|
| JP | 2002-270282 | 9/2002 |

* cited by examiner

*Primary Examiner*—Tulsidas C. Patel
*Assistant Examiner*—Vladilir Imas
(74) *Attorney, Agent, or Firm*—Armstrong, Kratz, Quintos, Hanson & Brooks, LLP

(57) ABSTRACT

A waterproof connector, which has a lock-releasing function without increasing the size of a connector housing thereof and has a relatively simple structure, and has a low cost without increasing the number of parts thereof, is provided. The waterproof connector includes: a waterproof sealing member mounted in a connector housing of the waterproof connector; a sealing holder for pressing the waterproof sealing member into the connector housing; and a slider slidably mounted to the connector housing, the slider including a lock-releasing part for releasing a lock between the connector housing and an opposite connector housing, wherein the sealing holder and the slider are connected integrally with each other through a breakable part and the breakable part is broken when the sealing holder is pressed.

3 Claims, 3 Drawing Sheets

WATERPROOF CONNECTOR

BACKGROUND OF THE INVENTION (1) Field of the Invention

The present invention relates to a waterproof connector, which includes a slider for releasing a coupling lock between male and female connectors and a sealing cover for pressing a waterproof sealing member in a connector.

(2) Description of the Related Art

FIG. 4 shows an example of a conventional waterproof connector (see Japanese Patent Application Laid-Open No. 2002-270282).

In this conventional waterproof connector, a waterproof connector 51 includes: a connector housing 52 made of synthetic resin; a mat seal (rubber stopper) 53 attached to the rear of the connector housing 52; and a sealing holder 54 made of synthetic resin for pressing the mat seal 53 onto the connector housing 52.

The connector housing 52 includes a hood part 55 having a chamber for fitting an opposite connector thereto and a receiving part 56 for receiving terminals therein formed integrally with the hood part 55 at the rear of the hood part 55, wherein the receiving part 56 includes a plurality of terminal-receiving chambers. The terminal-receiving chamber receives an electric wire-connecting part of the rear half of a male terminal (not shown in the figure). A tab-shaped contacting part of the front half of the male terminal protrudes inside the hood part 55.

The mat seal 53 is provided with holes 57 for guiding electric wires therethrough according to the respective terminal-receiving chambers. The sealing holder 54 is provided with holes 58 for guiding terminals therethrough. The sealing holder 54 is provided with ribs 59 and the mat seal 53 is provided with slits 60 for inserting the respective ribs 59 therein.

The mat seal 53 is attached to the connector housing 52 and the sealing holder 54 is provisionally fit to the mat seal 53 from the back of the mat seal 53, then a terminal with an electric wire is allowed to penetrate through the mat seal 53 from the rear of the sealing holder 54 so as to be inserted into the connector housing 52 and then, the sealing holder 54 is pressed thereto so that the mat seal 53 is pressed to and allowed to adhere to the receiving part 56 of the connector housing 52.

FIG. 5 shows another example of a conventional waterproof connector illustrating a fitting state of male and female connectors.

One connector housing 61 includes an outer hood part 70 and an inner housing 63, wherein the inner housing 63 acts as a terminal-receiving part and has cylinder parts 64 for the respective terminals at the rear of the inner housing 63. A ring-shaped waterproof rubber stopper (not shown in the figure), which adheres to an outer peripheral surface of an electric wire of a female terminal with the electric wire, is inserted in the corresponding cylinder part 64.

The hood part 70 is provided with a flexible locking arm 65. An opposite connector housing 62 is provided with a locking projection 66, which engages with the inside of a front end part 67 of the locking arm 65. An operation part 68 at the rear half of the locking arm 65 is pushed down, thereby releasing the lock.

The opposite connector housing 62 receives a male terminal with an electric wire (not shown in the figure) and a tab-shaped contacting part of the front half of the male terminal protrudes inside a hood part 69. The male and female terminals are connected to each other simultaneously when the connector housings 61 and 62 are fit to each other. A connector is composed by the connector housings 61 and 62 and the terminals (not shown in the figure).

However, as for the conventional waterproof connector shown in FIG. 4, since means for provisionally locking and fully locking the sealing holder 54 to the connector housing 52 are necessary, a structure of the sealing holder 54 becomes complicated, causing an increase in the cost of the waterproof connector.

Further, as for the conventional waterproof connector shown in FIG. 5, since it is necessary to have a large space for allowing the locking arm 65 to bend upon the release of the lock, thereby causing a problem that the connector housing 61 is enlarged in the height direction thereof. That is, a waterproof connector having a lock-releasing function has been desired without increasing the size of the connector housing. Furthermore, such a desired waterproof connector must be constructed without increasing the number of parts thereof. This is because if the number of parts increases, the number of parts of a mold and the cost of a mold for molding resin are increased, and the cost for controlling the parts and the man-hour for control are increases, thereby causing an increase in the cost of the waterproof connector.

SUMMARY OF THE INVENTION

It is therefore an objective of the present invention to solve the above problem and to provide a waterproof connector, which has a lock-releasing function without increasing the size of a connector housing thereof and has a relatively simple structure, and has a low cost without increasing the number of parts thereof.

In order to attain the above objective, the present invention is to provide a waterproof connector including:

a waterproof sealing member mounted in a connector housing of the waterproof connector;

a sealing holder for pressing the waterproof sealing member into the connector housing; and a slider slidably mounted to the connector housing, the slider including a lock-releasing part for releasing a lock between the connector housing and an opposite connector housing, wherein the sealing holder and the slider are connected integrally with each other through a breakable part and the breakable part is broken when the sealing holder is pressed.

With the construction described above, on a condition that the sealing holder and the slider are integrally formed with resin through a breakable part, the slider is mounted to the connector housing and the sealing holder that is formed in one piece with the slider is provisionally mounted to the connector housing. When the sealing holder is pressed in a direction of connector fitting, the breakable part is broken, so that the sealing holder is separated from the slider. The sealing holder presses and compresses the waterproof sealing member located in the connector housing so as to allow the waterproof sealing member to adhere to an inner surface of the connector housing. The slider moves (bends) the locking means of the connector housing with respect to the opposite connector housing, for example by its retreat motion, in a lock-releasing direction so as to release the lock. Since the lock-releasing means (i.e. slider) is formed separately from the locking means of the connector housing, a moving space for the locking means in a conventional connector housing (see FIG. 5) of the conventional waterproof connector becomes unnecessary, therefore the connector housing is prevented from being enlarged.

Further, with the construction described above, since the slider for releasing the lock of the connector and the sealing holder for pressing the waterproof sealing member are integrally formed with each other with resin, therefore a waterproof connector, which has a lock-releasing function without increasing the size of a connector housing thereof and has a relatively simple structure, and has a low cost without increasing the number of parts thereof, can be provided.

Preferably, the sealing holder and the slider are connected by a projection, the projection is provided with the breakable part, and the projection abuts against the connector housing when the breakable part is broken, so that the projection acts as a restriction member for restricting an end position of a forward movement of the slider.

With the construction described above, on a condition that the slider is mounted on the connector housing, the projection abuts against the connector housing so as to act as a stopper, thereby preventing the slider from moving forward further, and on such a condition the sealing holder is pressed forward, thereby breaking the breakable part. Since the projection functions both for restricting an end position of a forward movement of the slider and for connecting the slider with the sealing holder, thereby enabling the cost-down of the waterproof connector due to the simplification of the structure of the waterproof connector.

Preferably, the breakable part is a thin part formed thin with a notched part.

With the construction described above, the thin part that is the breakable part can be easily broken by pressing the sealing holder. Since the breakable part can be easily formed with resin, therefore the cost of the waterproof connector can be reduced.

DESCRIPTION OF THE PREFERRED EMBODIMENTS

Figure 2:
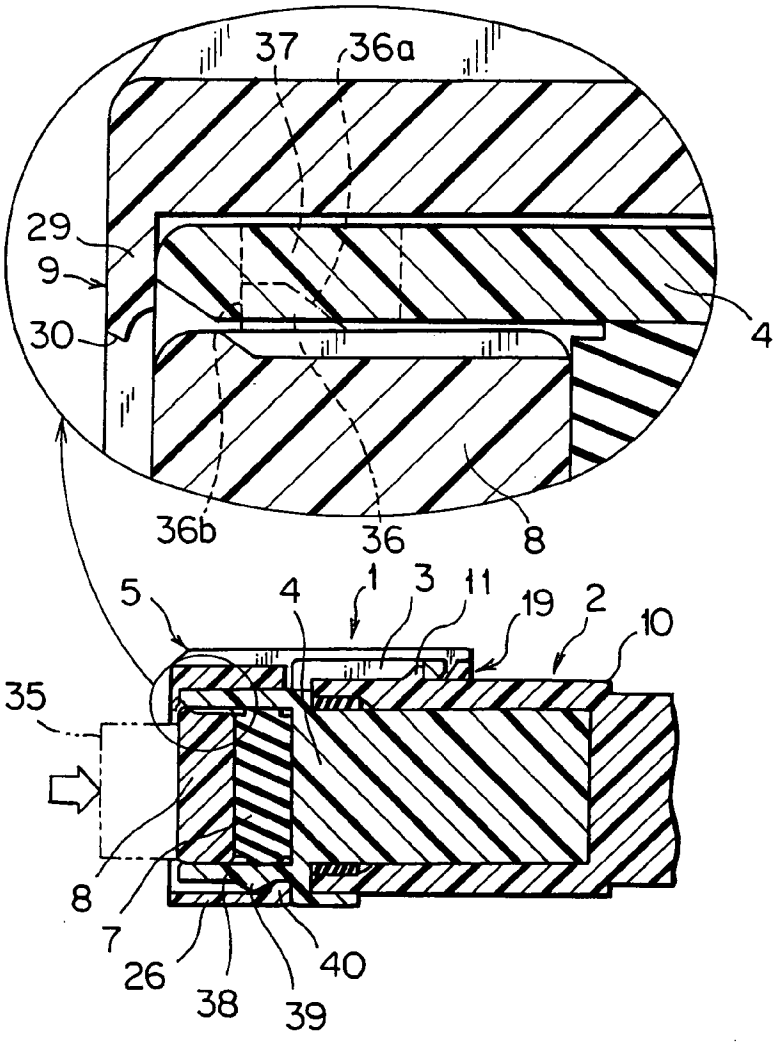
FIG. 2 is a longitudinal cross-sectional view illustrating a state when a sealing holder is completely attached in a waterproof connector according to the present invention.
Figure 1:
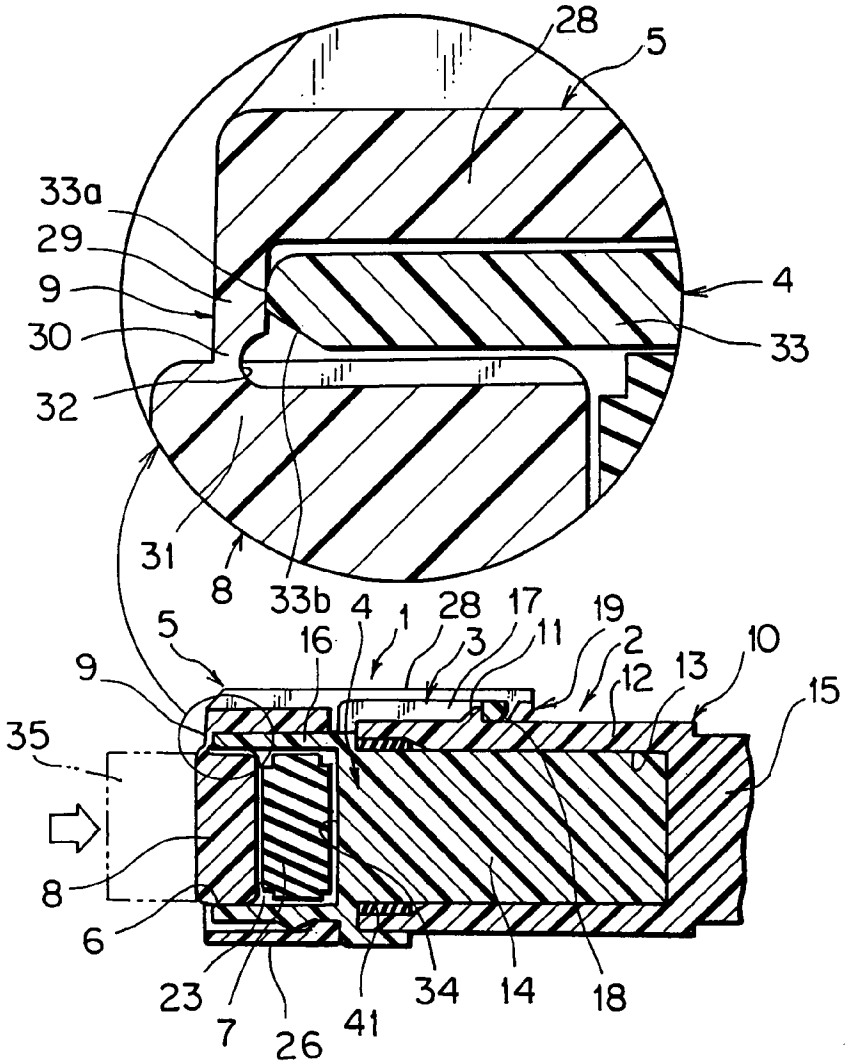
FIG. 1 is a longitudinal cross-sectional view illustrating a state before a sealing holder is completely attached in a preferred embodiment of a waterproof connector according to the present invention.
Figure 3:
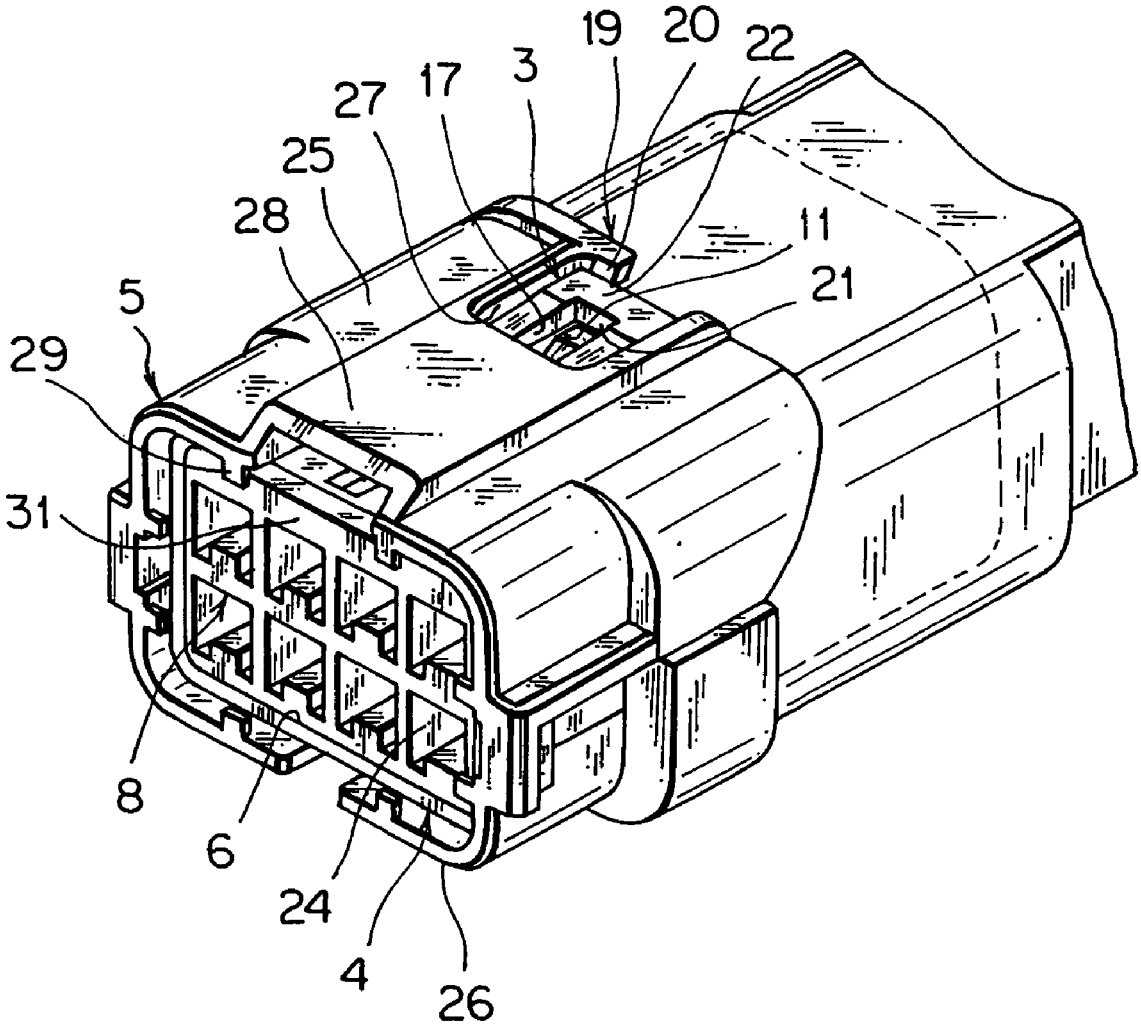
FIG. 3 is a perspective view illustrating a waterproof connector according to the present invention in a state when a sealing holder is completely attached.
Figure 4:
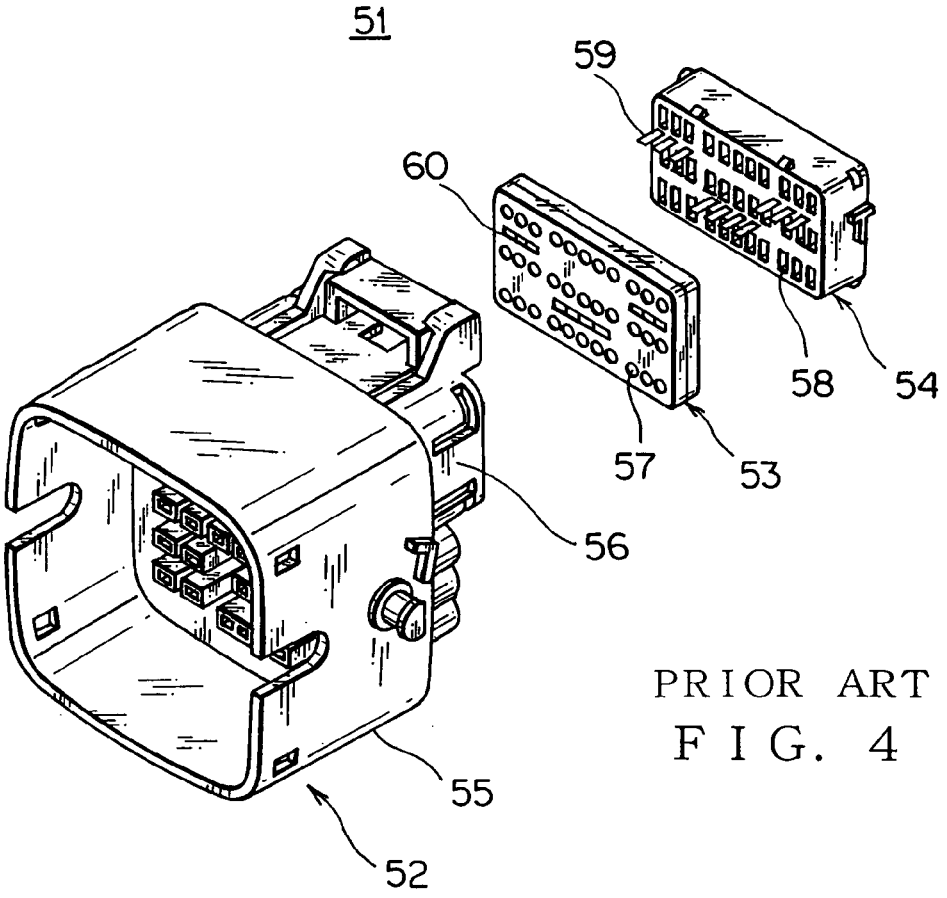
PRIOR ART FIG. 4
FIG. 4 is an exploded perspective view of an example of a conventional waterproof connector.
Figure 5:
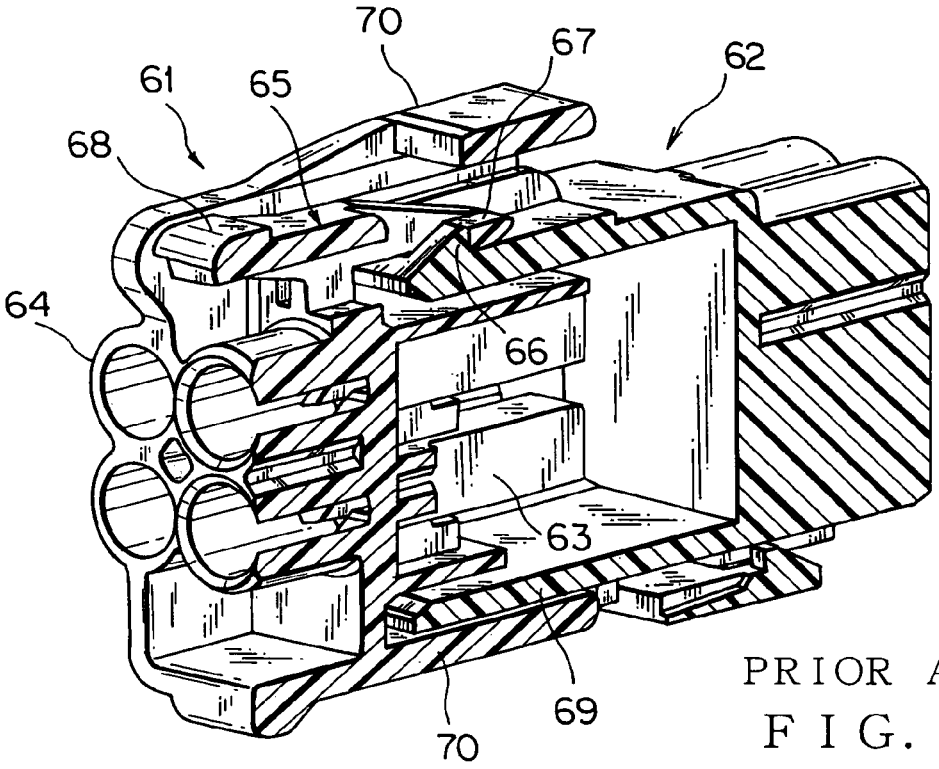
PRIOR ART FIG. 5
FIG. 5 is a perspective view of another example of a conventional waterproof connector illustrating with notching the interior thereof.

In the following, the preferred embodiments of the present invention will be explained with reference to the attached drawings. FIGS. 1–3 show a preferred embodiment of a waterproof connector according to the present invention.

A waterproof connector according to the present invention is composed of one connector 1 or of one connector 1 and an opposite connector (i.e. mating connector) 2. (This invention mainly relates to the one connector 1.) FIGS. 1–3 show coupling states of both connectors 1 and 2.

The one connector 1 includes: a connector housing 4 made of synthetic resin having a flexible cantilever locking arm 3; a slider 5 that is a lock-releasing member made of synthetic resin slidably mounted to the outside of the connector housing 4; a mat seal (waterproof sealing member) 7 to be mounted in the connector housing 4 from a rear opening 6 of the connector housing 4; and a sealing holder (cover) 8 made of synthetic resin that presses the mat seal 7 in the connector housing 4 from the rear, wherein the slider 5 and the sealing holder 8 are integrally connected to each other by a thin breakable hinge 9.

The mounting of the slider 5, mat seal 7 and sealing holder 8 to the one connector housing 4 is carried out before the fitting (coupling) of both connectors 1 and 2. Here, the connector 1 or connector 2 means a connector, in which terminals with electric wire are received in the corresponding connector housing 4 or 10.

The opposite connector 2 includes a locking projection (locking part) 11 that engages with the locking arm 3 on an outer surface of a hood part 12 of the connector housing 10. A terminal-receiving part 14 on the side of the front half of the one connector 1 is fit into a connector-fitting chamber 13 in the hood part 12 of the opposite connector housing 10 of the opposite connector 2. The terminal-receiving part 14 includes a plurality of terminal-receiving chambers (not shown in the figure), into which female terminals with electric wire (not shown in the figure) are mounted. A tab-shaped contacting part of a male terminal (not shown in the figure) received in a terminal-receiving part 15 of the opposite connector housing 10 of the opposite connector 2 is situated protrudingly in the connector-fitting chamber 13.

The locking arm 3 is formed on a horizontal wall (upper wall) 16 of a peripheral wall of the connector housing 4, wherein the locking projection 11 engages with a hole part 17 situated at the center in the width direction of the locking arm 3, and a lock-releasing projection (lock-releasing part) 19 of the slider 5 is situated in the proximity of an front side of an inward inclined surface 18 at a front end (end) of the locking arm 3. The lock-releasing projection 19 includes an outward inclined surface 20 (see FIG. 3) situated at a rear end along the inclined surface 18 and an inward inclined surface situated at a front end approximately parallel to the outward inclined surface 20. The lock-releasing projection 19 is formed integrally on an inner side of a front end of the slider 5.

The locking arm 3 is formed in a shape shown in FIG. 3 having the rectangular hole part 17 inside, wherein a front end of the hole part 17 is an abutting surface 21 to abut against a perpendicular engaging surface of the locking projection 11, a connection wall 22 continues to an front side of the abutting surface 21, and the inclined surface 18 (see FIG. 1) is formed at a front end of the connection wall 22. A base part (rear end) of the locking arm 3 is bent inwardly approximately perpendicularly and integrally continues crossing at right angles with the upper wall 16 at a middle of the connector housing 4 in the length direction thereof (i.e. between the terminal-receiving part 14 at the front half and a sealing holder-receiving part (also as a seal part) 23 at the rear half).

The receiving part 23 situated at the rear half receives the mat seal 7 having a rectangular shape in front view and the sealing holder 8 stuck in front and behind. The mat seal 7 includes hole parts (not shown in the figure) each having a round shape in cross section for guiding terminals with electric wire therethrough. As shown in FIG. 3, the sealing holder 8 includes hole parts 24 having a rectangular shape in cross section for guiding terminals with electric wire therethrough, wherein each hole part 24 is coaxial with the corresponding hole part of the mat seal 7. The hole parts 24 are partitioned by longitudinal and lateral partition walls and formed in parallel in a plurality of steps. A thickness of the mat seal 7 is about the same with that of the sealing holder 8. The mat seal 7 includes a lip part on an outer periphery thereof.

The slider 5 is formed in a rectangular pipe-shape in cross section so as to surround the outside of a rear half of the connector housing 4 and engages with the rear half of the connector housing 4 slidably in the connector-fitting direction. An upper wall 25 (see FIG. 3) of the slider 5 extends forward longer than a lower wall 26 thereof.

The lock-releasing projection 19 for releasing the locking arm 3 of the connector housing 4 is formed on an inner side of a front end of the upper wall 25 of the slider 5. A protection wall 28 having an inverse recess-shape in cross section is integrally formed at a middle of the upper wall 25 in the width direction thereof. An opening 27 (see FIG. 3) for exposing a front half of the locking arm 3 is formed on the protection wall 28 at the front half of the upper wall 25. The locking arm 3 can bend in a lock-releasing direction (upward direction) in the opening 27. The rear half of the locking arm 3 is protected from the outside without any interference in the protection wall 28.

A plurality of inward projections 29 (see FIG. 3) as stoppers are formed at the rear end of the slider 5. Each projection 29 abuts against the rear end of the connector housing 4 so as to prevent the slider 5 from further moving forward. Here, the forward direction means the connector-fitting direction, while the backward means the connector-parting direction. FIG. 3 shows a state when the sealing holder 8 is completely pressed in the receiving part 23 from the rear opening 6 of the connector housing 4.

On a condition that the sealing holder 8 is not yet pressed-in as shown in FIG. 1, the sealing holder 8 is integrally connected to the slider 5 through the breakable hinge 9. It is a feature of the present invention that the sealing holder 8 is formed in one piece with the slider 5 with resin material.

As shown in an enlarged view in FIG. 1, the projection 29 is perpendicularly formed at the rear end of the horizontal upper wall 28 of the slider 5, and the projection 29 continues integrally to an upper wall 31 near to a rear end of the sealing holder 8 through a thin part 30 at an end thereof. The thin part 30 is thinned with an inward notched part 32 so as to be breakable easily. The notched part 32 is formed in a semi-circular shape. The shape of the notched part 32 may be triangular or rectangular. The breakable hinge 9 is formed with the projection 29 and the thin part 30.

The projection 29 also acts as a stopper for restricting an end position of a forward movement of the slider 5. In the preferred embodiment described above, the sealing holder 8 situated inward is connected to a pair of projections situated right and left of the upper wall 28 of the slider 5 through the thin part 30. However, instead, the sealing holder 8 may be connected to a projection 29 situated above or below, or right and left of the slider 5 through the thin part 30.

As shown in FIG. 1, a rear end 33*a* of a peripheral wall 33 of the receiving part 23 of the connector housing 4 abuts against a front end surface of the projection 29 between the slider 5 and the sealing holder 8. The rear end of the connector housing 4 includes an inward tapered surface 33*b*. In a state shown in FIG. 1, the sealing holder 8 protrudes backward a little from the connector housing 4 and the slider 5. A front end surface of the mat seal 7 has a gap between itself and a front end surface 34 of the receiving part (receiving chamber) 23 of the connector housing 4.

When the rear end surface of the sealing holder 8 is forwardly pressed with a pressing tool 35 in a direction of an arrow shown in FIG. 1, the hinge 9 is cut from the thin part 30 so that the sealing holder 8 is completely inserted into the connector housing 4 together with the mat seal 7 as shown in an enlarged view in FIG. 2.

As shown in an enlarged view in FIG. 2, an engaging projection 36 is provided at least on an upper wall of the sealing holder 8, and the engaging projection 36 engages with an engaging hole 37 situated on the side of a rear end of the connector housing 4, so that the sealing holder 8 is fixed to the connector housing 4. The engaging projection 36 has an inclined surface 36*a* at the front and a perpendicular engaging surface 36*b* at the rear. The engaging hole 37 has perpendicular surfaces situated at the front and rear thereof. The number or arrangement of the engaging projection 36 and the engaging hole 37 is not limited to one, and they may be more than one according to the situation.

As shown in FIG. 2, a provisional locking projection 39 for the slider 5 is formed on an outer surface of a lower wall 38 of the receiving part 23 of the connector housing 4. A provisional engaging projection 40 is formed on an inner surface at a front end side of the lower wall 26 of the slider 5, at a front side of the provisional locking projection 39. An inclined surface at the rear side of the provisional engaging projection 40 abuts against an inclined surface at the front side of the provisional locking projection 39, so that the slider 5 is provisionally locked so as to be prevented from moving backward. When the slider 5 is moved backward by a force larger than the provisional locking force, the lock between the connectors 1 and 2 is released. When the slider 5 is mounted to the connector housing 4, the provisional engaging projection 40 climbs over the inclined surface at the rear side of the provisional locking projection 39.

As shown in FIG. 2, the sealing holder 8 and the slider 5 display their functions only after they are separated from each other by cutting. That is, the sealing holder 8 compresses the mat seal 7 so that the mat seal 7 resiliently sticks onto an inner wall surface of the receiving part 23 of the connector housing 4, and the sealing holder 8 sticks onto an outer peripheral surface of an electric wire in a terminal-guiding-through hole, thereby preventing water from entering into the connector 1. The insertion of a terminal with electric wire into the connector housing 4 may be carried out before or after the mat seal 7 is completely mounted. The terminals with electric wire are received in the connector housing 4, so that the connector 1 is constructed.

When the slider 5 is slid backward from the state shown in FIG. 2, the lock-releasing projection 19 at a front end of the slider 5 abuts against the inclined surface at a front end of the locking arm 3 and bends the locking arm 3 outward so as to allow the locking arm 3 to separate from the locking projection 11 of the opposite connector housing 10 of the opposite connector 2. Thereby, the lock between the connectors 1 and 2 is released. When the connectors 1 and 2 are pulled in the connector-parting direction, the fitting (coupling) of both connectors 1 and 2 is released, that is, the connection between the male and female terminals is released.

In FIG. 1, the reference numeral 41 denotes a ring-shaped waterproof packing which sticks between the connector housing 4 and the opposite connector housing 10. The opposite connector housing 10 may be arranged at an end of a wiring harness or directly attached on an instrument or the like.

The aforementioned preferred embodiments are described to aid in understanding the present invention and variations may be made by one skilled in the art without departing from the spirit and scope of the present invention.

For example, the lock-releasing means by the slider 5 may be modified according to a need. For example, a projection part may be provided instead of the hole part 27 (FIG. 3) of the locking arm 3 and a recess part may be provided instead of the locking projection 11 of the opposite connector housing 10, so that the locking arm in which the projection part is engaged with the recess part can be bent in the lock-releasing direction by the lock-releasing projection 19 of the slider 5.

Further, the hinge 9 which connects the slider 5 to the sealing holder 8 may be broken largely from the middle thereof so as to move the slider 5 forward, so that a locking arm (not shown in the figure) provided in the opposite connector 2 can be bent in the lock-releasing direction.

Further, the shape of the slider 5 may be an inverse recess-shape and the lock-releasing projection 19 may be formed on an upper wall of the slider 5, so that protruding strips (not shown in the figure), each located on an inner surface of a wall at both right and left of the slider, can be slidably engaged with a horizontal guide groove (not shown in the figure) of the connector housing 4.

Further, the connector housing 4, the sealing holder 8 and the locking means may be modified according to a need, for example, a projection may be provided instead of the engaging hole 37 of the connector housing 4 and a recess may be provided instead of the engaging projection 36 of the sealing holder 8.

Further, the provisional locking means between the slider 5 and the connector housing 4 may be modified according to a need, for example, a provisional locking recess for engaging the provisional engaging projection 40 of the slider 5 therewith may be provided instead of the provisional locking projection 39 of the connector housing 4. A provisional locking arm may be provided on the slider 5.

Furthermore, besides the projection 29, a part (stopper) for restricting the end position of a forward movement of the slider 5 with respect to the connector housing 4 may be provided.

What is claimed is:

1. A waterproof connector comprising:

a waterproof sealing member mounted in a connector housing of the waterproof connector;

a sealing holder for pressing the waterproof sealing member into the connector housing; and a slider slidably mounted to the connector housing, the slider including a lock-releasing part for releasing a lock between the connector housing and an opposite connector housing, wherein the sealing holder and the slider are connected integrally with each other through a breakable part and the breakable part is broken when the sealing holder is pressed.

2. The waterproof connector according to claim 1, wherein the sealing holder and the slider are connected by a projection, the projection is provided with the breakable part, and the projection abuts against the connector housing when the breakable part is broken, so that the projection acts as a restriction member for restricting an end position of a forward movement of the slider.

3. The waterproof connector according to claim 1 or 2, wherein the breakable part is a thin part formed thin with a notched part.

* * * * *